US010028061B2

(12) United States Patent
Espiritu

(10) Patent No.: US 10,028,061 B2
(45) Date of Patent: Jul. 17, 2018

(54) SPEAKER SURROUND STRUCTURE FOR MAXIMIZING CONE DIAMETER

(71) Applicant: HARMAN INTERNATIONAL INDUSTRIES, INCORPORATED, Northridge, CA (US)

(72) Inventor: Ronnie S. Espiritu, Castaic, CA (US)

(73) Assignee: Harman International Industries, Incorporated, Northridge, CA (US)

( * ) Notice: Subject to any disclaimer, the term of this patent is extended or adjusted under 35 U.S.C. 154(b) by 155 days.

(21) Appl. No.: 14/594,945

(22) Filed: Jan. 12, 2015

(65) Prior Publication Data

US 2015/0125024 A1 May 7, 2015

Related U.S. Application Data

(60) Continuation of application No. 13/346,560, filed on Jan. 9, 2012, now Pat. No. 8,934,656, which is a continuation of application No. 12/484,942, filed on Jun. 15, 2009, now Pat. No. 8,094,865, which is a division of application No. 10/610,383, filed on Jun. 30, 2003, now Pat. No. 7,548,631, which is a continuation of application No. 09/783,837, filed on Jan. 19, 2001, now abandoned.

(60) Provisional application No. 60/176,734, filed on Jan. 19, 2000.

(51) Int. Cl.

| | |
|---|---|
| ***H04R 25/00*** | (2006.01) |
| ***H04R 7/16*** | (2006.01) |
| ***H04R 7/20*** | (2006.01) |

(52) U.S. Cl.

CPC ..... *H04R 7/16* (2013.01); *H04R 7/20* (2013.01); *H04R 2307/204* (2013.01); *H04R 2307/207* (2013.01)

(58) Field of Classification Search

CPC ..... H04R 7/16; H04R 7/20; H04R 2307/207; H04R 2307/204; H04R 7/18

USPC ..... 381/398, 396, 403; 181/171–172

See application file for complete search history.

(56) References Cited

U.S. PATENT DOCUMENTS

| | | | |
|---|---|---|---|
| 2,439,666 | A | 4/1948 | Marquis |
| 2,722,991 | A | 11/1955 | Carbonneau |
| 3,095,941 | A | 7/1963 | Hassan |
| 3,160,716 | A | 12/1964 | Luth |
| 4,122,314 | A | 10/1978 | Matsuda et al. |
| 4,235,302 | A | 11/1980 | Tsukamoto |

(Continued)

FOREIGN PATENT DOCUMENTS

| | | |
|---|---|---|
| DE | 2943054 A1 | 5/1981 |
| JP | 4896121 | 12/1973 |

(Continued)

OTHER PUBLICATIONS

European Examination Report for corresponding European Application No. 10 012 998.0, dated Jan. 8, 2013, 4 pages.

(Continued)

*Primary Examiner* — Davetta W Goins
*Assistant Examiner* — Phylesha Dabney
(74) *Attorney, Agent, or Firm* — Brooks Kushman P.C.

(57) ABSTRACT

A surround that is generally arched in shape and that includes a radial exterior flange that extends downward from exterior side of the arched portion of the surround and that adhesively attaches to the inner wall or edge of the mounting ring of the frame or the loudspeaker.

19 Claims, 5 Drawing Sheets

(56) References Cited

U.S. PATENT DOCUMENTS

| | | | | |
|---|---|---|---|---|
| 4,433,214 | A | 2/1984 | Jasinski | |
| 4,590,332 | A | 5/1986 | Delbuck | |
| 4,748,759 | A | 6/1988 | Whiteing | |
| 5,111,510 | A | 5/1992 | Mitobe | |
| 5,115,474 | A | 5/1992 | Tsuchiya et al. | |
| 5,148,492 | A | 9/1992 | Uzawa et al. | |
| 5,148,942 | A | 9/1992 | Snook | |
| 5,687,247 | A * | 11/1997 | Proni | H04R 31/006 181/171 |
| 5,748,759 | A | 5/1998 | Croft et al. | |
| 5,867,583 | A | 2/1999 | Hazelwood et al. | |
| 5,892,185 | A | 4/1999 | Takahashi et al. | |
| 6,176,345 | B1 | 1/2001 | Perkins et al. | |
| 6,229,902 | B1 | 5/2001 | Proni | |
| 6,449,375 | B1 | 9/2002 | Hutt | |
| 6,567,528 | B1 | 5/2003 | Heed | |
| 6,568,503 | B2 * | 5/2003 | Proni | H04R 7/20 181/171 |
| 6,607,051 | B1 | 8/2003 | Peng | |
| 6,665,415 | B1 | 12/2003 | Heed | |
| 6,782,114 | B2 | 8/2004 | Ando et al. | |
| 6,959,714 | B1 | 11/2005 | Hakansson et al. | |
| 6,996,246 | B2 | 2/2006 | Ito | |
| 7,031,487 | B2 | 4/2006 | Stiles | |
| 7,356,157 | B2 | 4/2008 | Proni | |
| 7,529,380 | B2 | 5/2009 | Ueda et al. | |
| 7,548,632 | B2 * | 6/2009 | Fukuyama | H04R 7/24 181/171 |
| 2002/0051558 | A1 | 5/2002 | Kuze et al. | |

FOREIGN PATENT DOCUMENTS

| | | | |
|---|---|---|---|
| JP | 59174795 | | 11/1984 |
| JP | 60000198 | A | 1/1985 |
| JP | 09327088 | A | 12/1997 |
| JP | 11164391 | A | 6/1999 |
| WO | 02058433 | A1 | 7/2002 |

OTHER PUBLICATIONS

Korean Office Action, translation only, for corresponding Application No. 10-2008-7020117, dated Nov. 14, 2008, 4 pages.
Korean Final Office Action, translation only, for corresponding Application No. 10-2003-7009605, dated May 13, 2008, 5 pages.
Japanese Office Action with translation for corresponding Application No. 2002-558780, dated Nov. 16, 2006, 4 pages.
Japanese Final Office Action with translation for corresponding Application No. 2002-558780, dated Oct. 5, 2007, 4 pages.
European Examination Report for corresponding Application No. 10 012 998.0, dated Dec. 19, 2011, 5 pages.
European Extended Search Report for corresponding Application No. 10 012 998.0, dated Mar. 15, 2011, 6 pages.
Chinese First Office Action with translation for corresponding Application No. 200810096075.9, dated Jan. 26, 2011, 13 pages.
Chinese Third Office Action with translation for corresponding Application No. 200810096075.9, dated Mar. 31, 2012, 8 pages.
Supplementary European Search Report for corresponding Application No. 02704186.2, dated Feb. 26, 2007, 3 pages.
European Office Action for corresponding Application No. 10 012 998.0, dated May 29, 2013, 4 pages.
European Office Action for corresponding Application No. 10 012 998.0, dated Jul. 12, 2012, 3 pages.

* cited by examiner

SPEAKER SURROUND STRUCTURE FOR MAXIMIZING CONE DIAMETER

CROSS-REFERENCE TO RELATED APPLICATIONS

This application is a continuation of U.S. application Ser. No. 13/346,560 filed Jan. 9, 2012, which is a continuation of Ser. No. 12/484,942 filed Jun. 15, 2009, now U.S. Pat. No. 8,094,865, which is a divisional of Ser. No. 10/610,383 filed Jun. 30, 2003, now U.S. Pat. No. 7,548,631, which is a continuation of Ser. No. 09/783,837 filed Jan. 19, 2001, now abandoned, which, in turn, claims the benefit of U.S. provisional application Ser. No. 60/176,734 filed Jan. 19, 2000, the disclosures of which are hereby incorporated in their entirety by reference herein.

TECHNICAL FIELD

The present invention relates to loudspeakers and more particularly to a loudspeaker surround design that maximizes the cone diameter without the necessity of changing the outer dimensions of the loudspeaker frame.

BACKGROUND

The general construction of a loudspeaker driver consists of a diaphragm, voice coil, magnetic motor, frame and suspension system. The magnetic motor is generally attached to the frame. The voice coil and diaphragm are then mounted to the frame via the suspension system, which may include one or more suspension members. The voice coil of the driver typically consists of a voice coil former having a wire wound about the lower portion of the voice coil former. Often times, although not necessary, the voice coil former is encased in a wrapper. The suspension system of the driver acts to provide the stiffness of the driver and also provide air sealing for the driver. The configuration of the voice coil and diaphragm in the frame via the suspension system depends generally upon the design and size of the diaphragm relative to the voice coil.

Prior Art FIG. 1 illustrates the construction of a typically conventional dual-suspension driver and the typically connection of the surround to the frame and diaphragm. As seen in FIG. 1, the loudspeaker driver 100 consists of a diaphragm 102, voice coil 104, magnetic motor 106, frame 108 and suspension system, which consists of both a surround 110 and a spider 112. In a conventional dual-suspension driver 100, the diaphragm 102 of the driver 100 is formed as a cone and is substantially greater in diameter than that of the voice coil 104. In this type of construction, two suspension members are generally utilized. A "surround" suspension member 110 is connected to the diaphragm 102 at its outer edge mad extends outward from the diaphragm 102 to connect the diaphragm 102 to the frame 108. Similarly, a "spider" suspension 112 is connected to the voice coil 104 and extends from the voice coil 104 to the frame 108, connecting the voice coil 104 to the frame 104.

Prior Art FIG. 2 in an enlarged view of the encircled portion of FIG. 1 and illustrates the typical connection of the diaphragm 102 to the frame 108 via the surround 110. As seen in FIG. 2, the frame 108 includes an outer mounting ring 114, which includes a rim 116 and a general flat landing section 118. The rim 116 includes both an inner wall 120 and outer wall 122. A typical surround 110 has a central portion 124 that is generally half-circular or arched in shape. A radial planar exterior flange 126 extends about the outer diameter of the central arched portion 124 of the surround 110 for adhesive attachment to the landing section 118 of the outer mounting ring 114 of the frame 108. A radial planar interior flange 128 extends about the inner diameter of the central arched portion 124 of the surround 110. This radial planar interior flange 128 is designed for the adhesive attachment of the interior flange 128 to the diaphragm 102. The central arched portion 124 of the surround 110 is a flexible portion of the surround 110 and functions to constrain the diaphragm 102 radially yet allows it to vibrate in an axial direction when driven by the voice coil 104.

Prior Art FIG. 2 illustrates the position of the diaphragm and its surround in solid lines for the normal "at rest" condition. The displaced position of surround and diaphragm are shown in dashed lines for a maximum driven condition at maximum downward cone excursion. Displacement of the central arched portion of the surround provides an effective piston diameter that is somewhat larger than the cone diameter extending to a mid-region of the central arched portion.

Because of the need to provide adequate area to secure the diaphragm to the frame, as illustrated in prior art FIGS. 1 and 2, a large amount of diameter area, relative to the overall footprint or outside diameter of the loudspeaker, often is sacrificed. In certain applications, such as vehicular loudspeakers, the decreased diameter of the diaphragm relative to the overall speaker diameter can restrict the loudspeakers ability to operate at lower frequencies and thus achieve higher efficiency levels.

The area of a diaphragm is a major contributing factor to a loudspeaker's efficiency because as the size of a diaphragm of a loudspeaker becomes smaller, achieving acceptable low frequency response becomes more difficult. To achieve lower frequency responses, a loudspeaker is required to displace larger volumes of air, and the suspension stiffness must be reduced to maintain a low resonance corresponding to the lighter mass of the smaller driver. The volume of air that a loudspeaker can displace is dependent upon the area of the diaphragm and the range of motion allowed by the suspension, i.e., amount of vibrational excursion, or volume displacement, of the loudspeaker.

Large quantities of small-sized loudspeakers are used in vehicles such as cars, trucks, boats, aircraft, etc. Loudspeaker for use in vehicles are generally designed to mechanically fit a particular mounting pattern used by vehicle manufacturers, which typically includes a main cutout and surrounding mounting holes, dimensioned according to standards originating from different world regions. Original, as well as, replacement speakers are generally required to fit the mounting pattern and space originally provided in the vehicle. As such, the outer dimensions of the frame of the loudspeaker generally must meet these predefined dimensions.

Because of the size of the loudspeaker for use in vehicles is predefined, the area of the diaphragm of each loudspeaker is also thereby limited. While it would be very simple to increase the efficiency by increasing the size of the speaker diameter, if the frame diameter or any of its critical dimensions were changed, the loudspeaker would cease to become a standard sized loudspeaker and its application would thereby be limited. Small-sized or compact loudspeakers for use in vehicles are typically categorized according to the dimensions of the loudspeaker frames and are commonly found in the following nominal sizes—4 inch, 5¼ inch and 6½ inches.

Round speakers having basket diameter in the 4"-7" size range are manufactured in extremely high quantities for vehicular usage in the United States and throughout the world. Most of loudspeakers in the 6"-7" range are made to either a JIS Japanese standard that specifies 6.18 inches (157 mm) diameter or a DIN German standard used in Europe that specifies 6.69 inches (170 mm) diameter.

With the typically surround mounting construction described above, the area of the diaphragm is generally less that than that of the overall speaker size. Since the area of the diaphragm is a key factor in the efficiency of the loudspeaker, a useful factor of merit regarding size efficiency of a loudspeaker may be obtained by comparing the cone or diaphragm area to the total projected frame area. Table 1 below illustrates the diaphragm diameter, frame diameter, and the ration between the diaphragm area and the frame area for typical loudspeaker sizes of the construction described above.

TABLE 1

KEY DIMENSIONS IN POPULAR COMPACT SPEAKERS

| NOMINAL SIZE | VERSION | CONE DIAMETER (MM) | FRAME DIAMETER (MM) | RATIO OF CONE AREA/ FRAME AREA |
|---|---|---|---|---|
| 4 inch | | 73 | 102.3 | 0.51 |
| 5¼ inch | | 92 | 129 | 0.51 |
| 6½ inch | JIS Japan (a) | 111.8 | 157 | 0.51 |
| | (b) | 115.3 | 157 | 0.54 |
| | DIN Europe | 119.3 | 170 | 0.49 |

Table 1 shows that a conventional speaker structure typically provides a ratio of cone/basket area=0.51. The (b) version of the JIS type represents an effort to upgrade part way toward the DIN cone size and corresponding midrange and low frequency performance capability while retaining the smaller JIS basket size.

Practical all loudspeakers are subject to an inherent drop-out of acoustic efficiency at a low-end cutoff frequency in inverse proportion to the diaphragm area (for a given cone excursion). Thus, for full range speakers of any size, it is very beneficial to increase the cone diameter. Each percent that the cone diameter can be increased yields more than double the percent increase in diaphragm area. Accomplishing increased diaphragm area without increasing the outer dimensions of the speaker frame, whether the frame and diaphragm are round, oval or other shape, is particularly beneficial to midrange and low frequency performance of compact speakers that are subject to strict constraints on frame size, such as those used in vehicular sound systems as well as in small personal radio/stereo players, multi-media computer systems, etc.

A need therefore exists for mounting for the surround to the frame of the loudspeaker in a manner that would enable the use of larger conventional diaphragm sizes in frames having strict size constraints and accordingly enhance the midrange and low frequency performance of the loudspeakers.

SUMMARY

The invention is a surround that is generally arched in shape that includes a radial exterior flange, or outer attachment member, that extends downward from exterior side of the arched portion of the surround. This radial exterior flange departs from the conventional flange in that it extends generally directly downward, rather in outward, from the exterior side of the arched portion of the surround.

The mounting ring of the frame has a rim, having interior and exterior walls, and a landing section. Traditionally, the radial exterior flange of the surround would adhesively attach to the landing section of the mounting ring. In the invention, the exterior flange of the surround interfaces with the interior wall of the rim of the mounting ring and its lower edge merely rests on the landing section of the mounting ring. The exterior flange is then adhesively attached to the interior wall of the rim of the mounting ring. With this configuration, a diaphragm of the loudspeaker may be larger in diameter than those diameters conventionally used for a corresponding speaker of same frame size because the surround attachment increases the radiated area of the speaker without changing the outer dimensions of the frame.

In alternative embodiments, the exterior flange remains configured as a downward extension of the exterior central arched portion of the surround and remains secured adjacent to the interior wall of the rim. However, rather than affix the exterior flange directly to the interior wall of the rim of the mounting ring of the frame, the exterior flange may be secured adjacent to the interior wall of the rim by a channel. The channel may be either designed as part of the mounting ring of the frame or may be a separate piece that is affixed or adhered to the mounting ring of the frame.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood with reference to the following figures. The components in the figures are not necessarily to scale, emphasis instead being placed upon illustrating the principles of the invention. In the figures, like reference numerals designate corresponding parts throughout the different views.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 3:
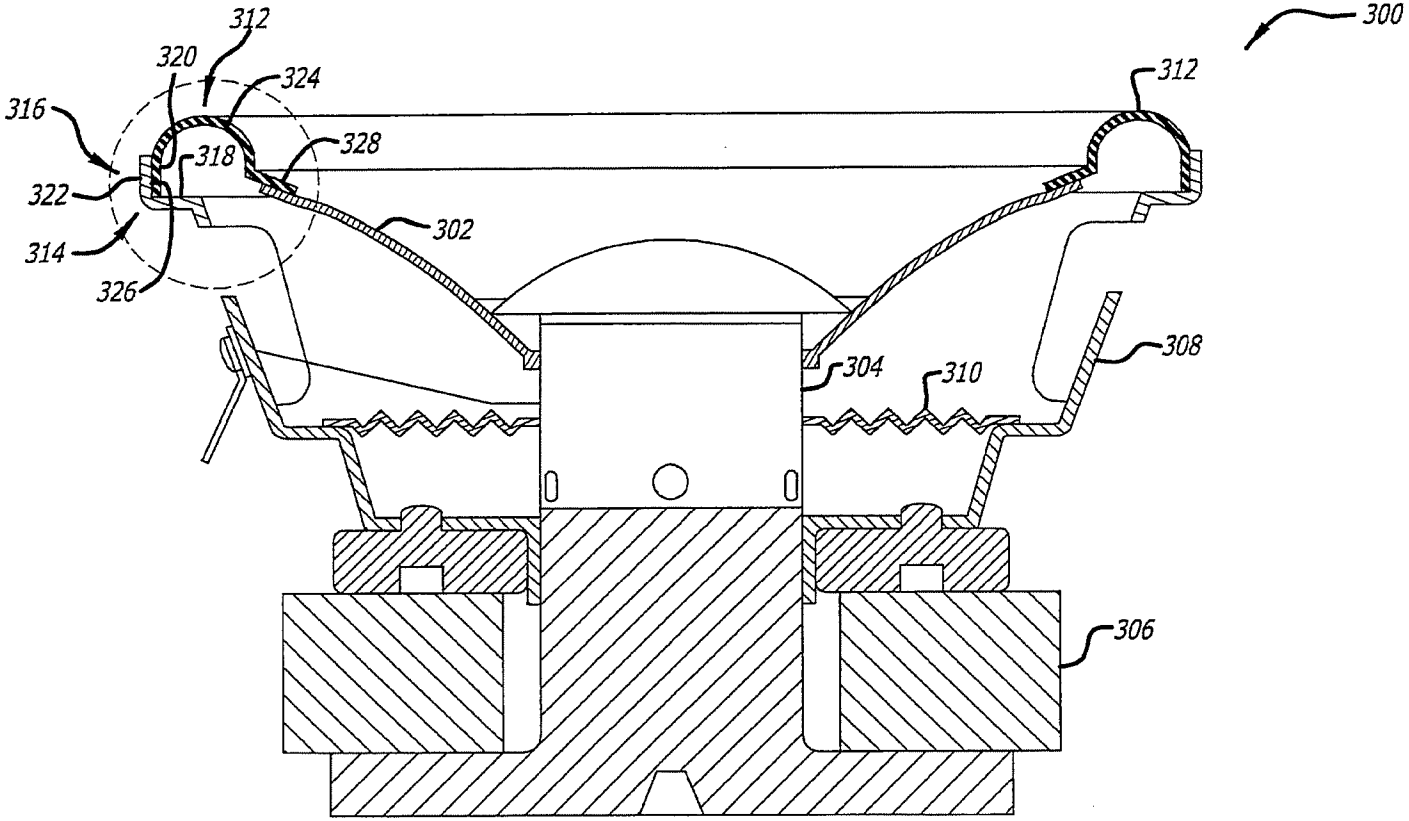
FIG. 3 is a side view of a loudspeaker driver of the present invention.

FIG. 3 illustrates a side view of one embodiment of a loudspeaker driver 300 of the present invention. As illustrated in FIG. 3, the loudspeaker driver 300 consists of a diaphragm 302, voice coil 304, magnetic motor 306, frame 308 and suspension system, which consists of both a spider 310 and a surround 312. The magnetic motor 306 is attached to the frame 308. The voice coil 304 and diaphragm 302 are mounted to the frame 308 via the suspension system 310 and 312. The voice coil 304 of the driver consists of a voice coil former (not shown) having a wire (not shown) wound about the lower portion of the voice coil former. The diaphragm 302 of the driver is formed as a cone and is substantially greater in diameter than that of the voice coil 304.

Two suspension members 310 and 312 are utilized in the suspension system. A "spider" suspension 310 is connected to the voice coil 304 and extends from the voice coil 304 to the frame 308, connecting the voice coil 304 to the frame 308. A surround suspension member 312 is connected to the diaphragm 302 at its outer edge and extends outward from the diaphragm 302 to connect the diaphragm 302 to the frame 308. The suspension system of the driver acts to provide the stiffness of the driver and also provide air sealing for the driver. Although FIG. 3, depicts the suspension system including both the surround 312 and the spider 310, loudspeaker driver suspensions do not always utilize a spider 310. In particular, in smaller sized speakers, the spiders 310 are often absence from the suspension system. The surround design of the invention may be used in loudspeaker drivers 300 with or without spider suspensions 310.

Figure 4:
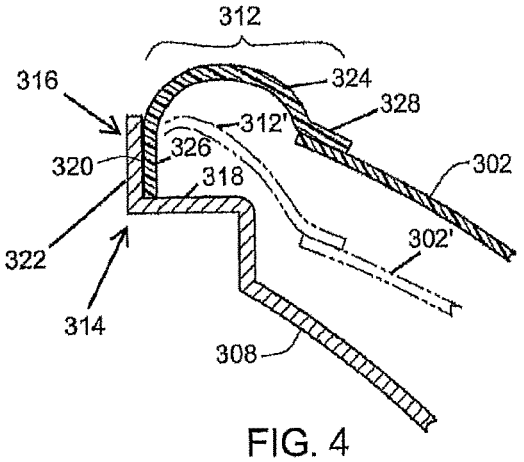
FIG. 4 is an enlarged view of the encircled portion of the loudspeaker driver illustrated in FIG. 3.

FIG. 4 is an enlarged view of the encircled portion of FIG. 3 and illustrates the connection of the diaphragm 302 to the frame 308 via the surround 310. As seen in FIGS. 3 and 4, the frame 308 includes an outer mounting ring 314, which includes a rim 316 and a general flat landing section 318. The rim 316 includes both an inner wall 320 and outer wall 322.

The surround 312 has an arched or central portion 324 that is generally half-circular or arched in shape. Similar to the prior art surround 312, a radial planar interior flange 328 extends about the inner perimeter of the central arched portion 324 of the surround 312. This radial planar interior flange 328 is designed for the adhesive attachment of the interior flange 328 to the diaphragm 302.

Figure 1:
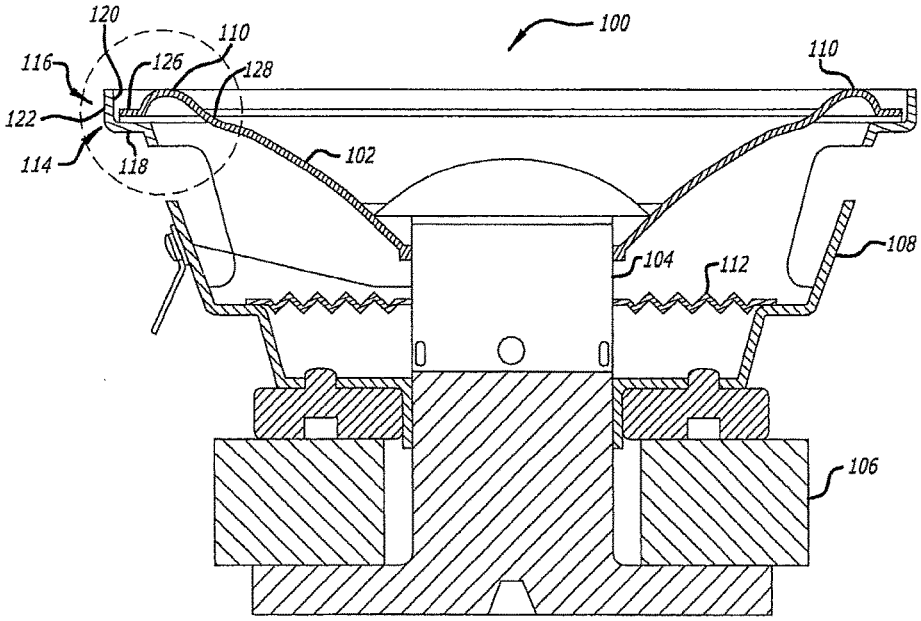
FIG. 1 Prior Art
FIG. 1 is a side view of a prior art loudspeaker driver.

A radial exterior flange 326, also known as an outer attachment member or axial skirt, extends generally downward from exterior side of the arched portion 324 of the surround 312. This radial exterior flange 326 departs from the conventional flange 114 (see prior art FIGS. 1 and 2) in that it extends generally directly downward, rather in outward, from the exterior side of the arched portion 324 of the surround 312. Thus, the exterior flange 326, which is used to attach the surround 312 to the diaphragm, is designed as a downward extension of the outer half of the arched portion 324 of the surround 312.

Rather than attaching to the landing section 118 of the mounting ring 314 of the frame 108, the exterior flange 326 of the surround 312 is positioned adjacent to and interfaces with the inner wall 320 of the rim 316 of the mounting ring 314 of the frame 308. The lower edge of the exterior flange 326 rests on the landing section 318 of the mounting ring 314. Exterior flange 326 is then adhesively attached at the interfacing surfaces of the inner wall 320 of the mounting ring 314 of the frame 308.

Both the exterior 326 and interior flanges 328 of the surround 312 are typically attached to the frame 308 and diaphragm 302, respectively, with conventional adhesives. However, the attachment of the exterior flange 326 to the surround 312 can be accomplished by other fixed and removable mechanisms which are common within the industry, including but not limited to the use of adhesives.

The surround 312 can be constructed from several materials commonly known in the industry, including, but not limited to, rubber, compressed foam rubber, corrugated cloth, paper, plastic, treated fabrics or other similar material that functions to constrain the diaphragm 302 radially yet allows it to vibrate in an axial direction when driven by the voice coil 304. The frame 308 can be made from a pressed sheet metal, molded from plastic or cast metal such as aluminum, or other material known in the art for use with loudspeaker frames.

While the above described surround design 312 is illustrated in a loudspeaker 300 having a generally round frame 308 and diaphragm 302, the surround design 312 may be utilized for any shape speaker frame 308, e.g., round, oval, rectangular or otherwise, and can be used in connection with frames 308 made of various materials, such as stamped steel or cast speaker frames 308.

When use in connection with vehicles, the loudspeaker drivers 300 are generally mounted with baffles or other mounting mechanism within the predefined openings of the vehicles. As such, the speakers generally include mounting gaskets, mounting rings, and sometimes, frame extensions or adapters (not shown) to assist with mounting the loudspeakers. These additional mounting devices are separate mechanical elements from the frame 308 and should not be considered part of the frame 308 of the loudspeaker 300.

Figure 2:
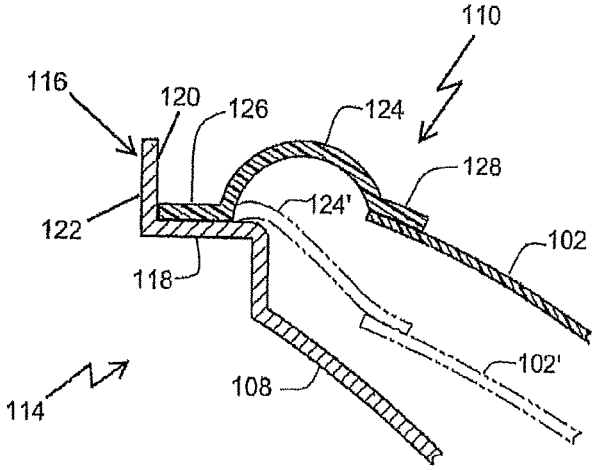
FIG. 2 Prior Art
FIG. 2 is an enlarged view of the encircled portion of the loudspeaker driver illustrated in FIG. 1.
Figure 5:
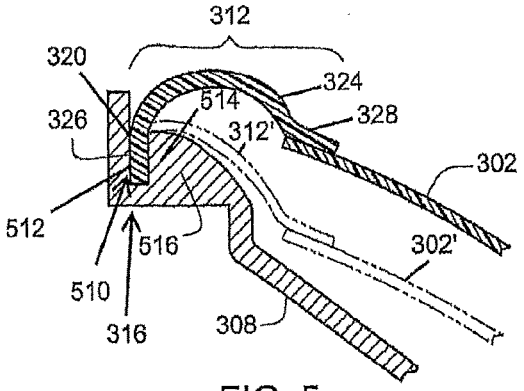
FIG. 5 is an alternative embodiment of the loudspeaker driver illustrated in FIG. 3.

FIG. 5 depicts an embodiment that utilizes the surround design 312 illustrated in FIGS. 2 & 3; however, the exterior flange 326 is fitted into an annular channel 510 whose outer wall 512 is formed by the inner wall 320 of the rim 316 and whose inner wall 514 is formed by a thickened region 516 of the frame 308, which may be molded from the same material as that of the frame 308. This configuration provides superior attachment reliability due to increased adhesive area in the interface between the inner wall 320 surface of the peripheral rim 316 of frame 308 and the outer wall of the exterior flange 326 and that of the inner wall of the exterior flange 326 and the inner wall 514 formed by the thickened region 516 of the frame 308.

Figure 6:
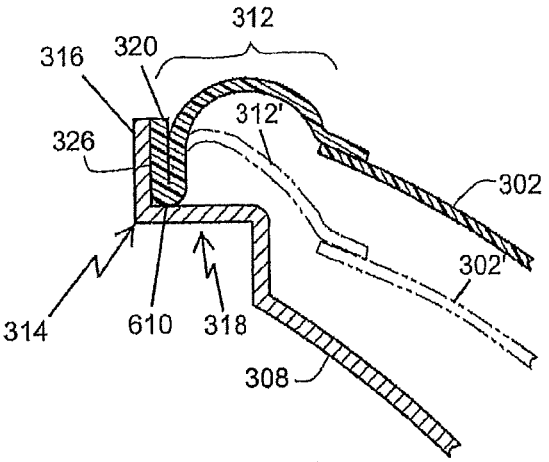
FIG. 6 is another alternative embodiment of the loudspeaker driver illustrated in FIG. 3.

FIG. 6 depicts an alternative embodiment where the exterior flange 326 is folded in two, or double backed on itself. The fold 610 of the flange is positioned such that it is resting on the landing 318 of the mounting ring 314. The exterior flange 326 is than adhesively fastened to the inner wall 320 of the rim 316 of frame 308 as well to the planar landing 318 of the mounting ring 314.

Figure 7:
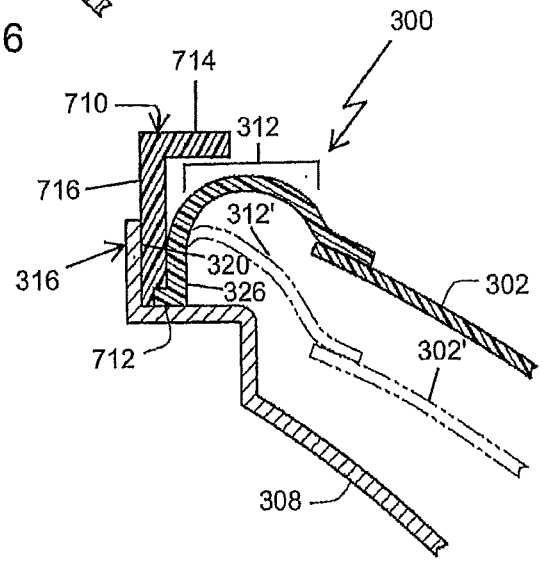
FIG. 7 is another alternative embodiment of the loudspeaker driver illustrated in FIG. 3.

FIG. 7 depicts an alternative embodiment of the invention that further includes a mounting adaptor 710, fitted between the exterior flange 326 and the inner wall 320 of the rim 316 of the frame 308. The use of the mounting adaptor 510 enables the speaker to be mounted onto the rear side of a speaker panel.

The exterior flange 326 is designed with a narrow fastening flange 712 extending outwardly from the edge of the exterior flange 326 and is fastened adhesively to the landing 318 of frame 308 and to a lower portion of the mounting adaptor 710. The mounting adaptor 710 may be molded from a plastic or formed or cast from a metal material, such as aluminum and may be formed with a horizontal arm 714 that will interface with the rear speaker panel and facilitate the mounting of the speaker. The adapter is fastened adhesively to the inner wall 320 of the rim 316 of frame 308. The lower end of the vertical portion 716 of the adaptor 710 acts downwardly on the narrow fastening flange 712 to provide additional interfacing area for downwardly on the narrow fastening flange 712 to provide additional interfacing area for enhancing the adhesive fastening of the flange 712 to the landing 318 of the frame 308.

Figure 8:
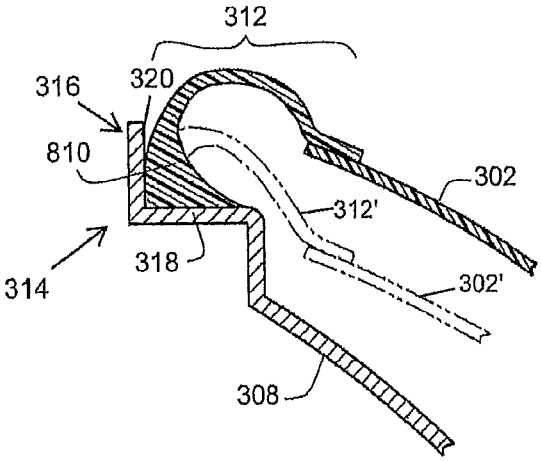
FIG. 8 is another alternative embodiment of the loudspeaker driver illustrated in FIG. 3.

FIG. 8 depicts an embodiment of the invention where the exterior flange 810 of the surround 312 is molded such that it gradually thickens at is nears the end of the flange 810, such that it flares to a thickness that enables an enlarged additional area of adhesive fastening of the flange 810 to the inner wall 320 of the rim 316 and to the planar landing 318 of the mounting ring 314 of the frame 308. The degree of gradually thicken of the flange 810 may vary by design such that contacts only a portion of the landing 318 of the mounting ring 314 or such that it contacts substantially all of the landing 318 of the mounting ring 314 of the frame 308, as illustrated by FIG. 8.

Figure 9:
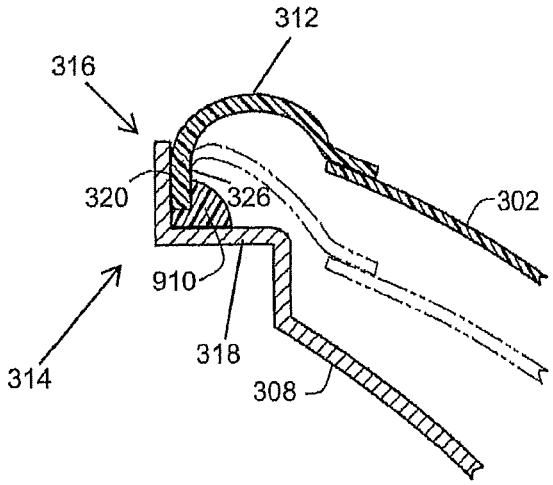
FIG. 9 is another alternative embodiment of the loudspeaker driver illustrated in FIG. 3.

FIG. 9 depicts a version of the basic embodiment of FIG. 3 where the surround 312 is the same as in FIG. 3 but is retained on the inside by an annular retainer ring 910, which is adhesively fastened to the landing 318 of the frame 308. The exterior flange 326 of the surround 312 is fastened in place adhesively to the inner wall 320 of the rim 316 of the frame 308 and at its interface with the ring 910.

Figure 10:
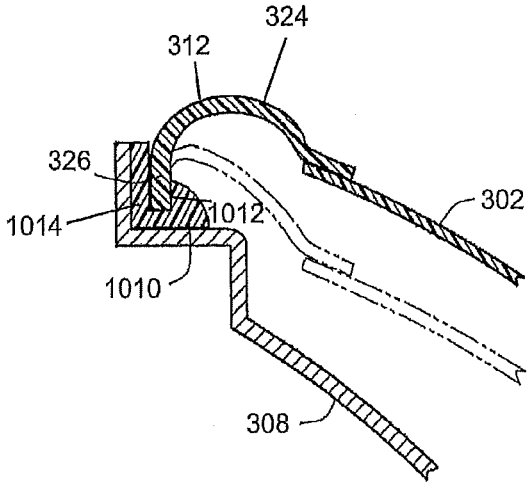
FIG. 10 is another alternative embodiment of the loudspeaker driver illustrated in FIG. 3.

FIG. 10 depicts an alternative embodiment of that illustrated in FIG. 9. In this embodiment, retainer ring 1010 is designed with an annular channel 1012 that accepts the exterior end of the exterior flange 326 of the surround 312. The thickness of the outer wall 1014 of the retainer ring 1010 may be adjusted to take into account the necessary dimensions of the diaphragm 302 relative to the frame 308 and the span of the flexible arched portion 324 of suspension member 312 relative to the frame 308 and diameter of the diaphragm 302.

By way of example, in a 4" round speaker with a conventional basket having 129 mm outer diameter, incorporation of most embodiments of the present invention will enable the conventional cone diameter (92 mm) to be increased to approximately 102.6 mm. This is an increase in diaphragm of 11.5% in diameter and 24.4% in area, which provides significant improvement of low frequency response. Additionally, the diaphragm area/frame area accomplished by using the surround designs set forth above may be increased in the 4" category to approximately 0.633, compared to 0.51 for conventional speakers, which an increase of 24% of diaphragm area/frame area.

In any of the embodiments, the arched portion 324 of the surround 312 may be made uniform in thickness or specially varied in thickness for increased compliance, e.g. shaped to be thinner in a central region 324 and/or one or both flanges 326 and 328 may be tapered.

The above loudspeaker dimensions are given by way of example only. One skilled in the art will recognize that the above configuration can be incorporated into speaker systems of various sizes and shapes and is not limited to the dimension described above, but may vary based upon the desired application.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A loudspeaker comprising:

a frame having a mounting ring, the mounting ring including a rim extending from a planar landing;

a diaphragm;

a surround having a top surface opposite a bottom surface, the surround extending between the diaphragm and the frame; and an annular retaining ring including an interface and being positioned directly on the planar landing to receive the surround at the interface, wherein the annular retaining ring is adhesively fixed to the planar landing to position the annular retaining ring directly on the planar landing; and wherein the interface and an interior wall of the rim define a gap and the annular retaining ring includes an extending portion positioned directly below the gap and above the planar landing.

2. The loudspeaker of claim 1 wherein the rim includes an interior wall that extends from the planar landing and in parallel with at least a portion of the bottom surface of the surround and at least a portion of the annular retaining ring.

3. The loudspeaker of claim 2 wherein the top surface of the surround is adhesively fixed to the interior wall of the rim, and the bottom surface of the surround is adhesively fixed to the annular retaining ring to increase a diameter of the diaphragm.

4. The loudspeaker of claim 3, wherein the interior wall extends in a non-parallel direction from the planar landing.

5. The loudspeaker of claim 3, wherein the interior wall extends in a perpendicular direction to the planar landing.

6. The loudspeaker of claim 1 wherein the interface is formed on an inside portion of the annular retaining ring to receive the bottom surface of the surround.

7. The loudspeaker of claim 1 wherein at least a portion of the surround is positioned over the annular retaining ring.

8. The loudspeaker of claim 7, wherein the portion of the surround is at least an arched portion of the surround.

9. The loudspeaker of claim 1 wherein the surround is positioned within the gap and directly above the extending portion and wherein the extending portion prevents the surround from contacting the planar landing.

10. The loudspeaker of claim 1, wherein the rim extends generally upward from the planar landing and forms an outer perimeter of the loudspeaker, wherein at least a portion of the top surface of the surround extends generally downward toward the planar landing and is adhesively fixed to the rim to increase a diameter of the diaphragm.

11. The loudspeaker of claim 1, wherein the planar landing receives the bottom surface of the surround at the interface.

12. The loudspeaker of claim 1, wherein the frame includes a frame area, and the diaphragm includes a diaphragm area, wherein a ratio of the diaphragm area to the frame area is greater than 0.54 to increase low frequency response performance of the loudspeaker.

13. The loudspeaker of claim 1, wherein the frame includes a frame area, and the diaphragm includes a diaphragm area, wherein a ratio of the diaphragm area to the frame area is between 0.60 and 0.63 to increase low frequency response performance for the loudspeaker.

14. The loudspeaker of claim 1, wherein the frame includes a frame area, and the diaphragm includes a diaphragm area, wherein a ratio of the diaphragm area to the frame area is approximately 0.63 to increase low frequency response performance for the loudspeaker.

15. A loudspeaker comprising:

a frame having a mounting ring, the mounting ring including a rim extending from a planar landing;

a diaphragm;

a surround having a top surface opposite a bottom surface, the surround extending between the diaphragm and the frame; and an annular retaining ring including an interface and being positioned directly on the planar landing to receive the surround at the interface, wherein the annular retaining ring is adhesively fixed to the planar landing to position the annular retaining ring directly on the planar landing; and wherein the rim extends generally upward from the planar landing and forms an outer perimeter of the loudspeaker, wherein at least a portion of the top surface of the surround extends generally downward toward the planar landing and is adhesively fixed to the rim to increase a diameter of the diaphragm.

16. A loudspeaker comprising:

a frame having a mounting ring, the mounting ring including a rim extending from a planar landing;

a diaphragm;

a surround having a top surface opposite a bottom surface, the surround extending between the diaphragm and the frame; and an annular retaining ring including an interface and being positioned directly on the planar landing to receive the surround at the interface, wherein the annular retaining ring is adhesively fixed to the planar landing to position the annular retaining ring directly on the planar landing; and wherein the frame includes a frame area, and the diaphragm includes a diaphragm area, wherein a ratio of the diaphragm area to the frame area is greater than 0.54 to increase low frequency response performance of the loudspeaker.

17. A loudspeaker comprising:

a frame having a mounting ring, the mounting ring including a rim extending from a planar landing;

a diaphragm;

a surround having a top surface opposite a bottom surface, the surround extending between the diaphragm and the frame; and an annular retaining ring including an interface and being positioned directly on the planar landing to receive the surround at the interface, wherein the annular retaining ring is adhesively fixed to the planar landing to position the annular retaining ring directly on the planar landing; and wherein the frame includes a frame area, and the diaphragm includes a diaphragm area, wherein a ratio of the diaphragm area to the frame area is between 0.60 and 0.63 to increase low frequency response performance for the loudspeaker.

18. A loudspeaker comprising:

a frame having a mounting ring, the mounting ring including a rim extending from a planar landing;

a diaphragm;

a surround having a top surface opposite a bottom surface, the surround extending between the diaphragm and the frame; and an annular retaining ring including an interface and being positioned directly on the planar landing to receive the surround at the interface, wherein the annular retaining ring is adhesively fixed to the planar landing to position the annular retaining ring directly on the planar landing; and wherein the frame includes a frame area, and the diaphragm includes a diaphragm area, wherein a ratio of the diaphragm area to the frame area is approximately 0.63 to increase low frequency response performance for the loudspeaker.

19. A loudspeaker comprising:

a frame having a mounting ring, the mounting ring including a rim extending from a planar landing;

a diaphragm;

a surround having a top surface opposite a bottom surface, the surround extending between the diaphragm and the frame; and an annular retaining ring including an interface and being positioned directly on the planar landing to receive the surround at the interface, wherein the annular retaining ring is adhesively fixed to the planar landing to position the annular retaining ring directly on the planar landing, wherein the rim includes an interior wall that extends from the planar landing and in parallel with at least a portion of the bottom surface of the surround and at least a portion of the annular retaining ring, and wherein the top surface of the surround is adhesively fixed to the interior wall of the rim, and the bottom surface of the surround is adhesively fixed to the annular retaining ring to increase a diameter of the diaphragm.

* * * * *